US005933096A

United States Patent [19]

Tsuda

[11] Patent Number: 5,933,096

[45] Date of Patent: Aug. 3, 1999

[54] NON-STOP AUTOMATIC TOLL COLLECTION SYSTEM

[75] Inventor: Yoshiaki Tsuda, Tokyo, Japan

[73] Assignee: Mitsubishi Denki Kabushiki Kaisha, Tokyo, Japan

[21] Appl. No.: 08/988,388

[22] Filed: Dec. 10, 1997

[30] Foreign Application Priority Data

Jan. 17, 1997 [JP] Japan ..... 9-006925

[51] Int. Cl.[6] ..... G08G 1/00

[52] U.S. Cl. ..... 340/928; 340/907; 340/933; 340/935; 235/384; 342/44

[58] Field of Search ..... 340/928, 933, 340/936, 937, 907, 904, 935, 905, 539, 991, 994, 825.32, 825.54; 342/42, 44, 51; 235/384; 701/117

[56] References Cited

U.S. PATENT DOCUMENTS

| | | | |
|---|---|---|---|
| 5,086,389 | 2/1992 | Hassett et al. | 364/401 |
| 5,289,183 | 2/1994 | Hassett et al. | 340/905 |
| 5,310,999 | 5/1994 | Claus et al. | 235/384 |
| 5,648,767 | 7/1997 | O'Connor et al. | 340/928 |
| 5,686,906 | 11/1997 | Ono et al. | 340/928 |
| 5,701,127 | 12/1997 | Sharpe | 342/42 |
| 5,705,996 | 1/1998 | Eguchi et al. | 340/928 |
| 5,708,425 | 1/1998 | Dwyer et al. | 340/928 |
| 5,714,932 | 2/1998 | Castellon et al. | 340/539 |

FOREIGN PATENT DOCUMENTS

WO9118354 11/1991 WIPO .

OTHER PUBLICATIONS

Yukio Yokota,"Magnetic Card Toll Collection System", The Toshibad Review, 1985, vol. 40, No. 3, pp. 189–192.

"Magnetic Ticket Type Toll–Collection System", Mitsubishi Heavy Industries Technical Report, Nov. 1985, vol. 22, No. 6, pp. 127–132.

"Non–Stop Toll Collection", Yomiuri Shinbun, Morning Edition, Oct. 29, 1996, pp. 26–27.

Nikkei Mukku,"All About Intelligent Transport Systems", published Nov. 6, 1995 by Nihon Keizai Shimbun–sha, pp. 139–142, 168–171, and 190–191.

"Need and Technology Development for Traffic Management System of Expressway", Mitsubishi Heavy Industries Technical Report, Jul. 1995, vol. 32, No. 4, pp. 264–267.

"Disappearing Toll Gates", Asahi Shimbun, Morning Edition, Sep. 28, 1996, p. 31.

*Primary Examiner*—Jeffery A. Hofsass
*Assistant Examiner*—Davetta Woods
*Attorney, Agent, or Firm*—Burns, Doane, Swecker & Mathis, L.L.P.

[57] ABSTRACT

In a non-stop automatic toll collection system for exchanging information by radio between a vehicle-mounted device mounted on a vehicle and a toll station, the toll station side comprises two receivers having different directional properties. The gain of one receiver is high when the vehicle is inside a toll collection area in which a toll charge is collected, and the gain of the other receiver is high when the vehicle is outside this toll collection area. It can therefore be determined whether the source emanating the received radio waves is inside or outside the toll collection area by comparing the intensity of the signal received by these two receivers.

12 Claims, 15 Drawing Sheets

NON-STOP AUTOMATIC TOLL COLLECTION SYSTEM

BACKGROUND OF THE INVENTION

1. Field of the Invention

This invention relates to a non-stop automatic toll collection system for automatically collecting a toll charge from vehicles traveling on a toll road without requiring the vehicles to stop.

2. Description of the Prior Art

Conventionally, magnetic card toll collection systems have been used on toll roads. These systems are described in detail in for example, "Magnetic Card Toll Collection System", the Toshiba Review (Vol.40, No.3), 1985, p.189–p.192, or in "Magnetic Ticket Type Toll-Collection System", Mitsubishi Heavy Industries Technical Report Vol.22, No.6(1985–11), p.127–p.132.

In these conventional systems, when a vehicle left an ordinary road to travel on a toll road, or conversely, when a vehicle left the toll road to travel on an ordinary road, it had to make a temporary stop at a toll station to receive a travel ticket or pay a toll fee. This situation led to vehicles queuing in front of the toll station. Hence, non-stop automatic toll collection systems have been proposed wherein fee collection is made without vehicles having to stop.

Such systems are described in detail in, for example, "Need and Technology Development for Traffic Management System of Expressway", Mitsubishi Heavy Industries Technical Report Vol.32, No.4(1995–7), p.264–p.267, "The Fight for Leadership in Japan/U.S./Europe Regarding "Signaling" from Roads to Vehicles", NIKKEI BUSINESS, Jan. 13, 1995, p.155–p.158, and Published Translation of PCT Filed Patent No. Hei 5-508492 (Koho), "Electronic Vehicle Toll Collection Device and Method". A particularly full description appears in Published Translation of PCT Filed Patent No. Hei 5-508492 (Koho).

In Japan, non-stop automatic toll collection systems are being jointly developed by the Government and the private sector, and according to an article which appeared in the Yomiuri Shinbun of Oct. 29, 1996 (morning edition, p.26–p.27), plans are under way with a view to the commercial use of such systems by fiscal year 1999.

According to Nikkei Mukku (published Nov. 6, 1995), "Everything about ITS", systems of the type described in the above patent (Koho) are already in use in some countries, e.g. in Europe (Germany, Norway, etc., p.168–p.171), U.S.A., (p.140–p.143) and South-East Asia (Malaysia, Singapore, etc., p.190–p.191).

FIG. 1 shows the outlines of a conventional nonstop toll collection system.

A toll collection area 10 for receiving tariffs by radio is defined by an entry sensor 12 and exit sensor 14. The constructions of the entry sensor 12 and exit sensor 14 are identical, these sensors detecting the passage of a body traveling within approximately 2 m from a road surface. The entry sensor 12 is situated at the front end of the collection area 10, while the exit sensor 14 is arranged at the rear end of the toll collection area 10.

When a vehicle 16 enters the area 10 in a direction shown by an arrow Y in the figure, its front end is detected by the entry sensor 12. Communication then takes place between a vehicle-mounted device 18 mounted on the vehicle 16 and an antenna 20, and a tariff is collected.

However in this conventional system, due to the characteristics of radio waves, the antenna 20 may pick up radio waves from outside the toll collection area 10. This is due to scattering of radio waves when there is a radio wave leakage area 22 due to the installation position of the antenna 20, as shown in FIG. 1. It may also occur due to, for example, the entry and exit sensors 12, 14, ticket vending machines for vehicles not equipped with the vehicle-mounted device 18 or tariff boxes where there are collection personnel.

Consequently, there was a problem in that communication sometimes took place with vehicle-mounted devices 18 outside the collection area.

There was also a problem in that mistakes were sometimes made in distinguishing vehicles carrying the vehicle-mounted device 18 (Electronic Toll Collection Vehicles, referred to hereafter as ETC vehicles) and vehicles not carrying the vehicle-mounted device 18 (non-ETC vehicles).

For example, when a non-ETC vehicle enters the toll collection area 10 alone, there is no information exchange by radio, so it may be assumed that this vehicle is a non-ETC vehicle. However, when an ETC vehicle and a non-ETC vehicle are traveling close together, it may occur that the ETC vehicle is incorrectly determined to be a non-ETC vehicle.

An example of this is seen in FIG. 2, when the ETC vehicle 16 is following a non-ETC vehicle 24 in front of it, and is incorrectly determined to be a non-ETC vehicle. In this case, when the non-ETC vehicle 24 in front enters the toll collection area 10, communication is established between the antenna 20 and the vehicle-mounted device 18 of the ETC vehicle 16 behind due to the existence of the radio wave leakage area 22, so it is incorrectly determined that such communication has taken place with the non-ETC vehicle 24. As a result, a tariff is not collected from the non-ETC vehicle 24. Moreover, since the vehicle-mounted device 18 on the ETC vehicle 16 determines that communication has terminated, no further exchange of information occurs with the antenna 20 even when the vehicle enters the toll collection area 10, so the ETC vehicle 16 is then determined to be a non-ETC vehicle.

The ETC vehicle 16 therefore has to pay the fee for the non-ETC vehicle 24 which was traveling in front of it, and also has to pay the fee directly to a member of the toll collecting personnel.

SUMMARY OF THE INVENTION

This invention, which was conceived in view of the above problems, therefore aims to provide an automatic toll collection system ensuring that communication takes place only with a vehicle entering a toll collection area so that tariffs are collected correctly.

To achieve the aforesaid objectives, the automatic toll collection system according to this invention comprises a first receiver having first directional characteristics installed in a toll station for receiving a signal from a vehicle-mounted device, and a second receiver having second directional characteristics installed in a toll station for receiving a signal from a vehicle-mounted device, it being determined whether a received signal originates from a vehicle inside or outside a toll collection area from a difference between these first and second directional characteristics. When a vehicle-mounted device is within the toll collection area, the first and second directional characteristics are such that the intensity of the signal received from the second receiver is greater than the intensity of the signal received from the first receiver. Conversely, when the vehicle-mounted device is outside the toll collection area, the intensity of the signal received from the second receiver is less than the intensity of the signal received from the first receiver. Hence by comparing the intensity of the first and second receivers, it can be determined whether the vehicle is within the toll collection area. This determination is performed by a determining unit, and the determining unit also authorizes collection of a tariff based on the determination result.

Either the first or second receiving unit may comprise a variable attenuator for adjusting the intensity of the received signal. If this is done, fine adjustment of the limits of the collection area may be made from the difference of first and second directional characteristics, and it is easy to set up the characteristics of the system when the system is installed.

The determining unit also permits tariff collection at or above a predetermined value based on the SN ratio of the second receiver. In this way, noise can be definitively eliminated.

The determining unit may comprise a comparator which compares the intensity of the received signals from the first and second receivers, and a gate which transmits the output of the second receiver when it is determined by the comparator that the intensity of the signal received from the second receiver is higher.

The determining unit may also comprise a sign inverter for inverting the sign of the signal received from the first receiver, an adder for adding the signal received from the first receiver and the sign-inverted signal received from the first receiver, a comparator for comparing the output of the adder with 0, and a gate for transmitting the addition result when it is determined by the comparator that the output of the adder exceeds 0.

DESCRIPTION OF THE PREFERRED EMBODIMENTS

Embodiment 1

Figure 1:
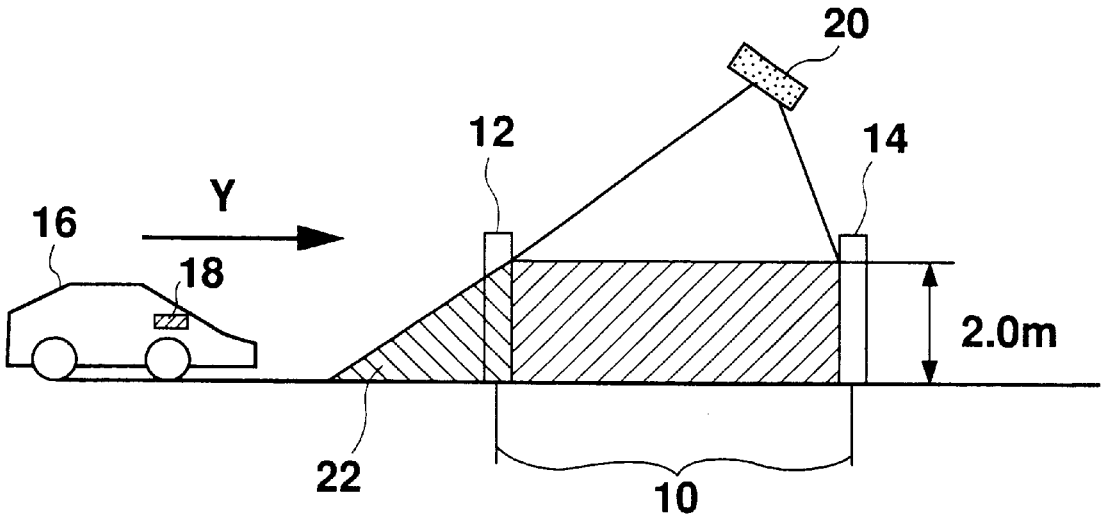
FIG. 1 is a schematic view of the construction of a conventional non-stop automatic toll collection system.
Figure 2:
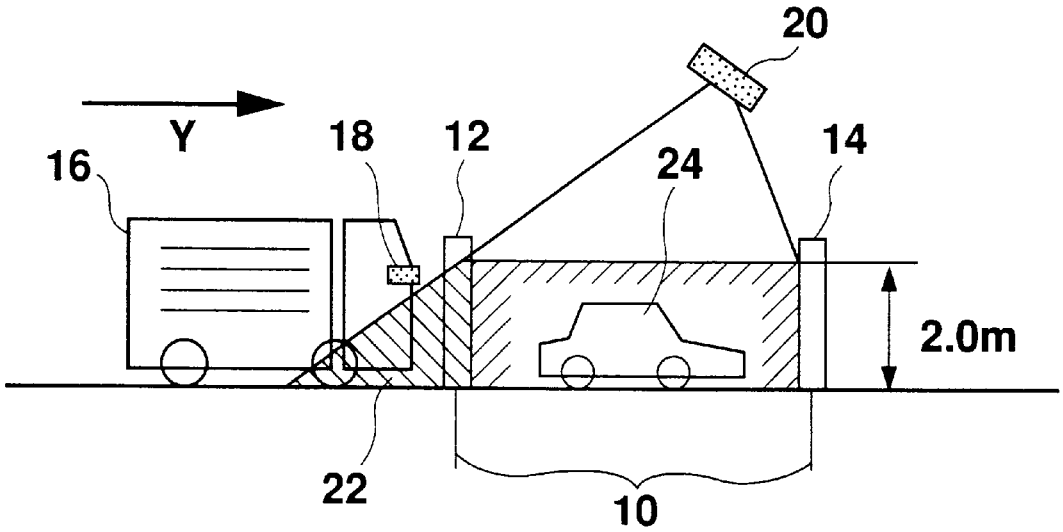
FIG. 2 is a diagram describing an example of incorrect operation due to a conventional non-stop automatic toll collection system.
Figure 3:
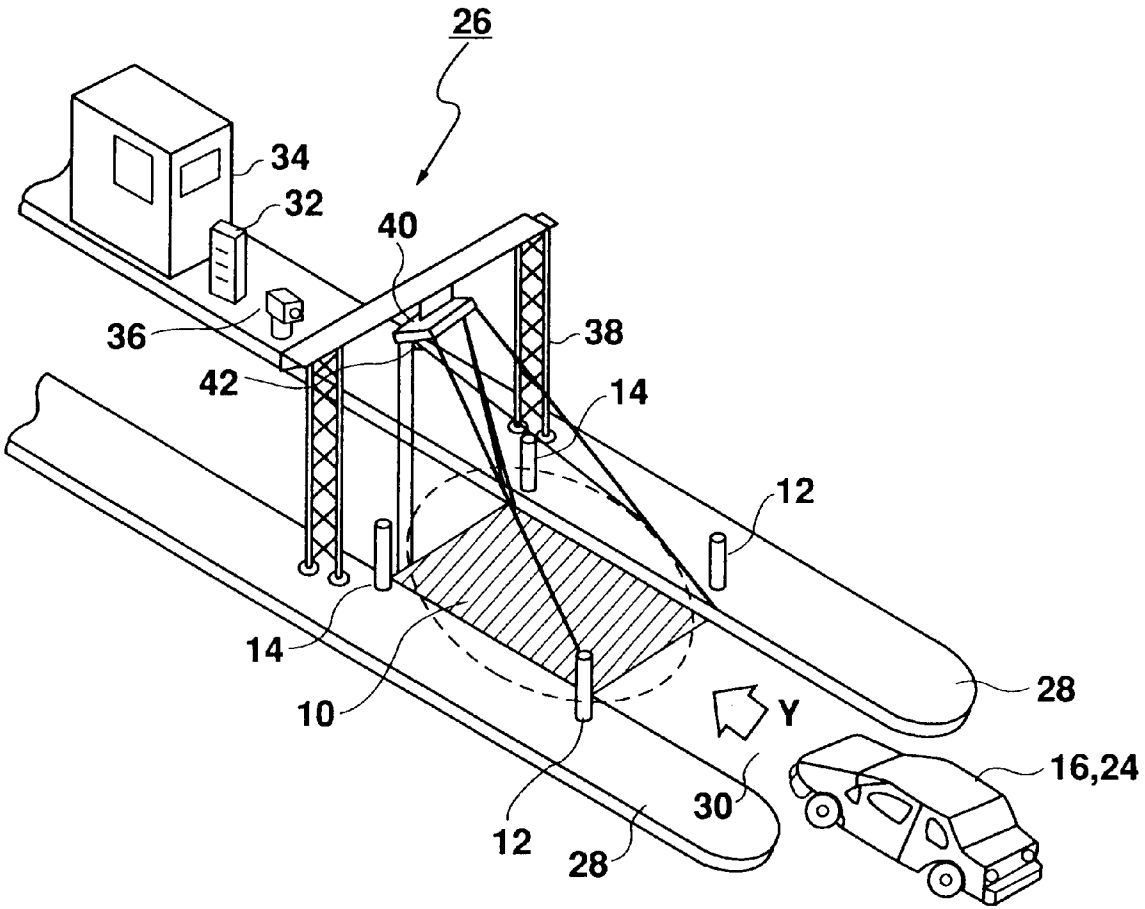
FIG. 3 is a schematic drawing of a toll station using a non-stop automatic toll collection system according to this invention.

FIG. 3 is a schematic view of a toll station 26 using a nonstop automatic tariff collection system according to this invention. It may occur that both an ETC vehicle and a non-ETC vehicle pass through this toll station 26 on a lane 30 separated by separating belts 28. The lane 30 is of such a width that these vehicles 16, 24 cannot enter the station alongside each other. An entry sensor 12 and exit sensor 14 are installed on the side of this lane 30, a toll collection area 10 being provided between these sensors 12, 14. The entry sensor 12 detects that the front end of a vehicle has entered the toll collection area 10, and the exit sensor 14 detects that the front end of a vehicle has left the toll collection area 10.

A ticket-issuing machine 32 for issuing transit tickets to non-ETC vehicles and a toll box 34 manned by toll station personnel, are installed at the rear of the toll collection area 10. The staff in the toll station box 34 collect a toll charge from non-ETC vehicles. Also installed is a vehicle-distinguishing unit 36 which distinguishes the type of vehicle, i.e. lorry or passenger vehicle, etc.

A sector beam antenna 40 and broad beam antenna 42 are supported by a supporting gate 38 above the road 30. The sector beam 40 has relatively strong directionality, and high sensitivity to radio waves emanating from within the collection area 10. On the other hand the broad beam antenna 42 has relatively weak directionality, and relatively high sensitivity also to radio waves emanating from outside the collection area 10. The two antennae start operating when a vehicle is detected by the entry sensor 12 to have entered the toll collection area 10, and stop operating when the vehicle is detected by the exit sensor 14 to be leaving the toll collection area 10.

If the toll collection area 10 is too large, a plurality of vehicles may enter the area together so that it is no longer possible to separate them. On the other hand, if the toll collection area 10 is too small, not enough time is available to collect information. The size of the toll collection area 10, i.e. the antennae 12, 14, must therefore be set appropriately. According to this embodiment, the distance between the entry sensor 12 and exit sensor 14 is set to approximately 4 m. If the incoming vehicle is an ETC vehicle, tariff collection information is exchanged between the toll station 26 and vehicle-mounted device 18 via the broad beam antenna 40.

As described above, when a non-ETC vehicle 24 and ETC vehicle 16 are traveling on the road 30, it may occur that toll fee collection does not take place correctly. Also, when there are two parallel roads 30, it may occur that radio waves are received from a vehicle running on the adjacent road.

However, the two antennae 40, 42 respectively have different directional properties, and their function is such that radio waves received from outside the toll collection area 10 are not incorrectly determined to be from a vehicle inside the collection area. Specifically, the intensity of a radio wave received by the sector beam antenna 40 is compared with the intensity of the radio wave received by the broad beam antenna 42, and the vehicle from which the wave emanated is determined to be either an ETC vehicle or a non-ETC vehicle based on this comparison.

Figure 4:
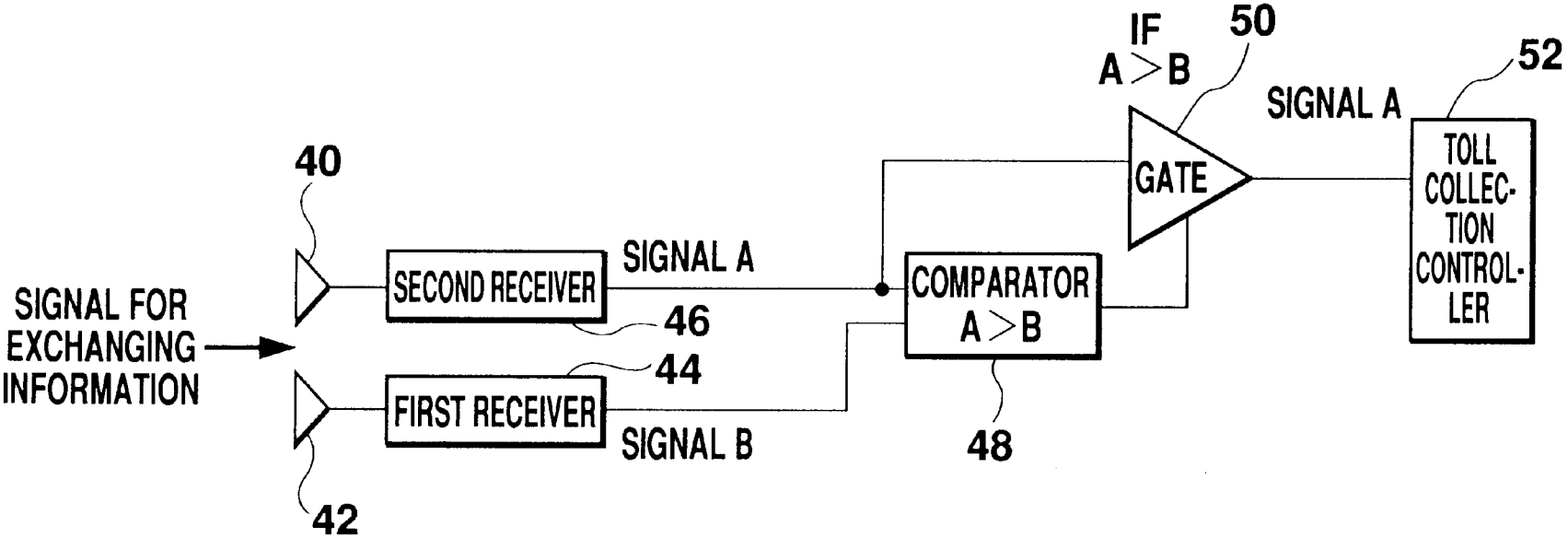
FIG. 4 is a block diagram of a first example of a receiving system of the non-stop automatic toll collection system according to this invention.

FIG. 4 is a block diagram showing the construction of a system for determining whether a received signal has emanated from a vehicle outside or inside the toll collection area 10. The signal from the vehicle-mounted device 18 is received by both the sector beam antenna 40 and broad beam antenna 42. A first receiver 44 is connected to the broad beam antenna 42, and the first receiver outputs a received signal B having an intensity which depends on the intensity of the received radio wave. A second receiver 46 is connected to the sector beam antenna 40, and it outputs a received signal A having an intensity which depends on the intensity of the received radio wave. The two received signals A, B are compared by a comparator 48, and when the received signal A is stronger, a first gate 50 is opened. Therefore, the received signal A is output by the gate 50 only when the signal A is stronger than the signal B. Based on this output, a toll collection controller 52 collects a charge.

Figure 5:
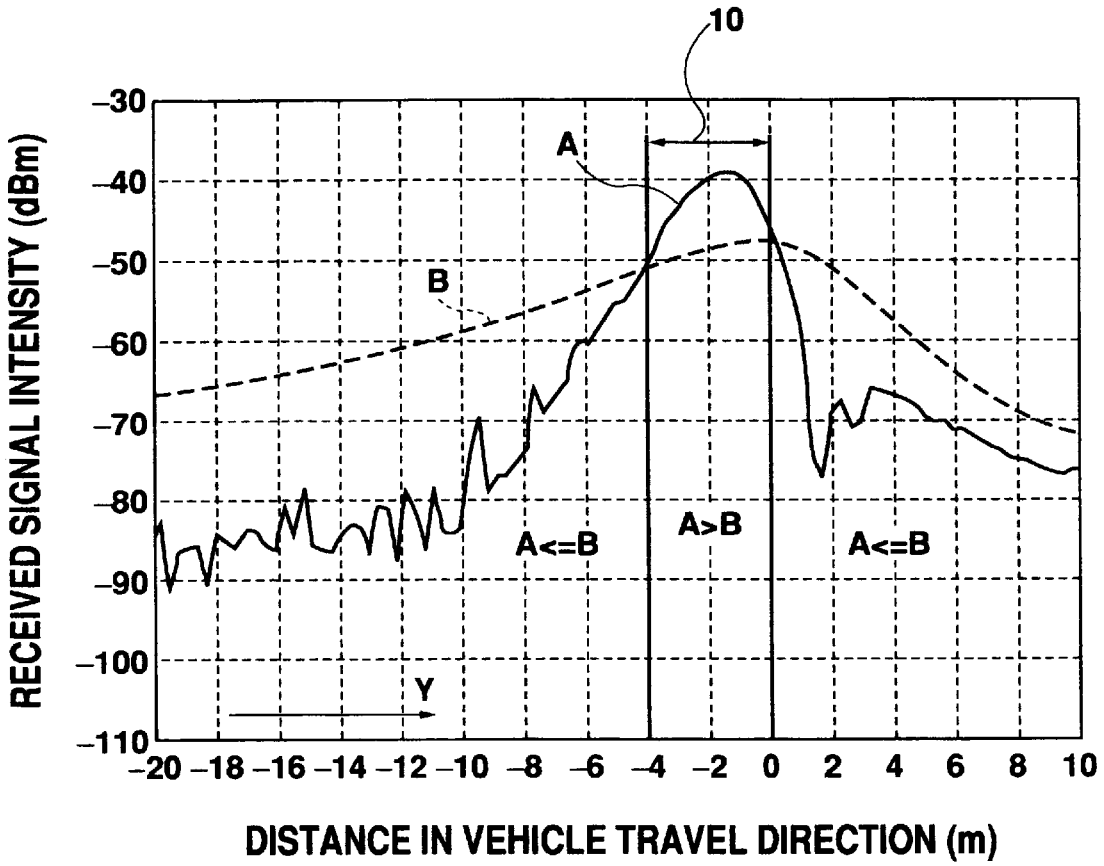
FIG. 5 is a diagram showing the directional properties of a sector beam antenna and a broad beam antenna in the non-stop automatic toll collection system according to this invention.

FIG. 5 shows the directional properties of the sector beam antenna 40 and broad beam antenna 42. The horizontal axis shows the position of the vehicle-mounted device 18 taking the travel direction of the vehicle as positive, and the installation position of the exit sensor 14 as the origin. The vertical axis shows the intensity of the signal received by the two antennae 40, 42 when the vehicle-mounted device 18 transmits a radio wave with a constant power. As shown in the figure, the intensity of the signal A received by the sector beam antenna 40 is high in the vicinity of the toll collection area 10, and low when the vehicle is outside this area. The intensity of the signal B received by the broad beam antenna 42 is also high in the vicinity of the toll collection area 10, and is not much different compared to the intensity of signal A from the sector beam antenna 40. Further, when the vehicle is inside the toll collection area 10, the intensity of the signal A is high, whereas when the vehicle is outside the toll collection area 10, the intensity of the signal B is high. Specifically, the directional properties and gains of the two antennae are determined such that these characteristics are obtained.

Figure 6:
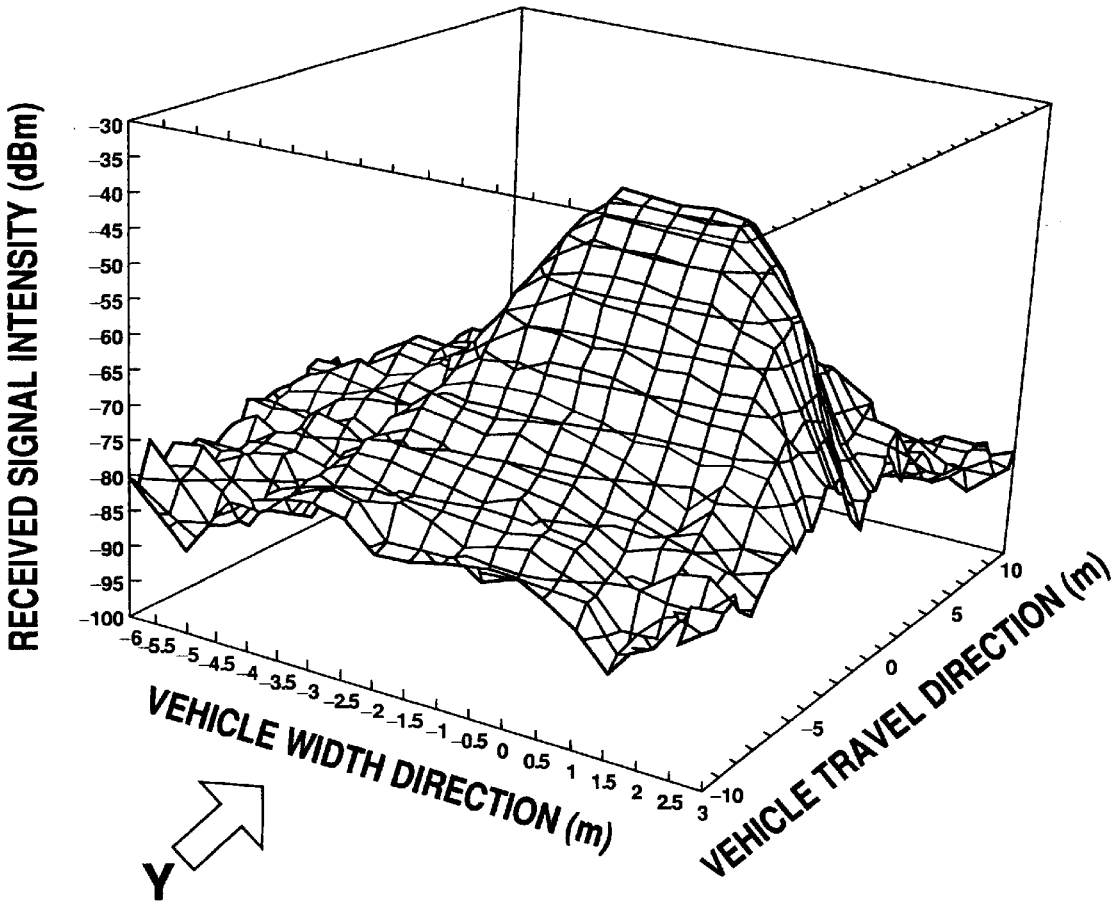
FIG. 6 is a diagram showing measured values of the intensity of a signal received by the sector beam antenna of the non-stop automatic toll collection system according to this invention.

FIG. 6 shows the intensity of the signal A when a radio wave is received by the sector beam antenna 40 from the vehicle-mounted device 18 when the E.I.R.P. (Equivalent Isotropically Radiated Power) is 13 dBm at a frequency of 5.8 GHz. The toll collection area 10 is an area defined by a range in the vehicle width direction of −1.5 m to 1.5 m, and a range in the vehicle travel direction of 0 m to −4 m.

Figure 7:
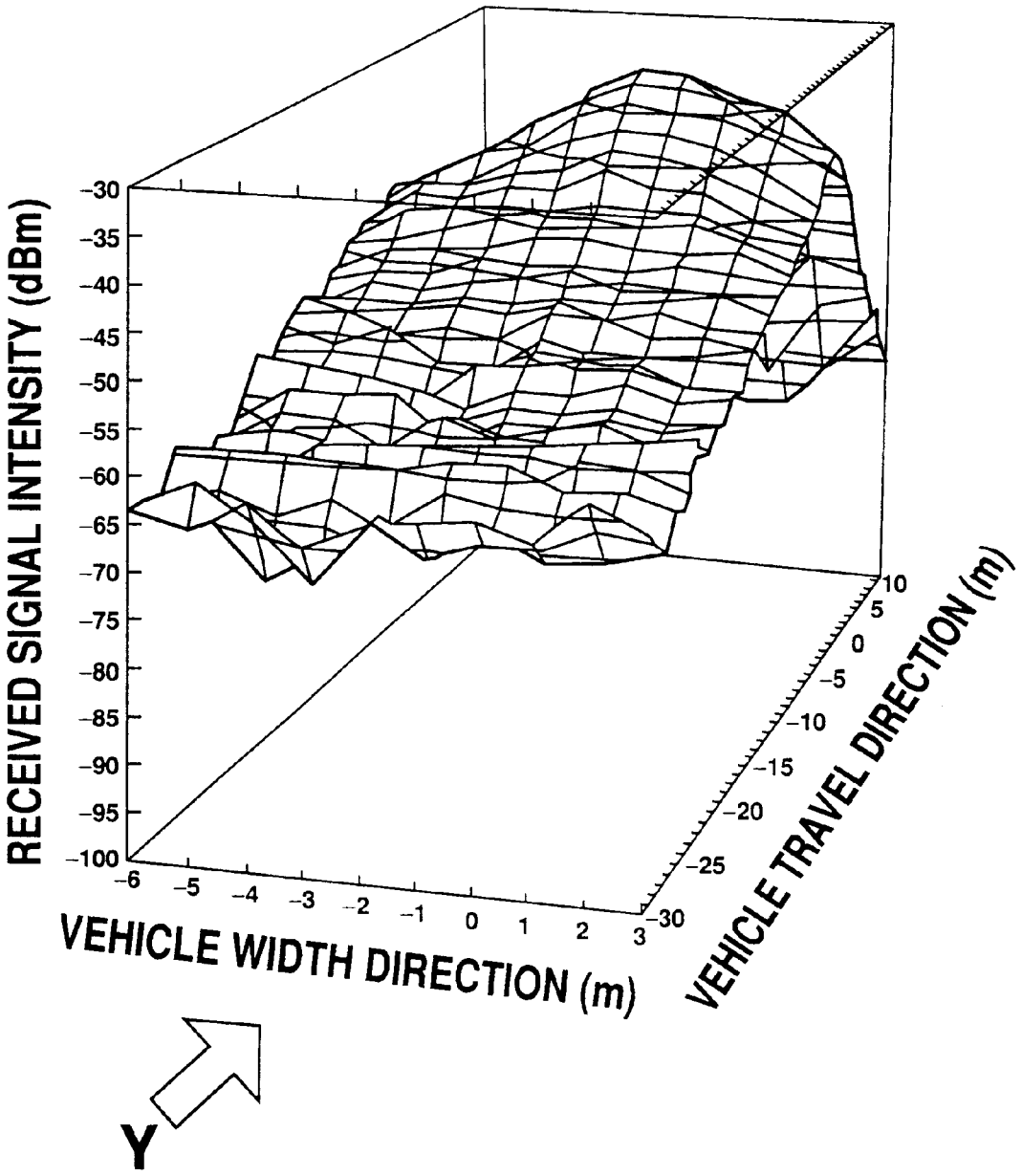
FIG. 7 is a diagram showing measured values of the intensity of a signal received by the broad beam antenna of the non-stop automatic toll collection system according to this invention.

Similarly, FIG. 7 shows the intensity of the signal B when a radio wave is received by the broad beam antenna 42 from the vehicle-mounted device 18.

Figure 8:
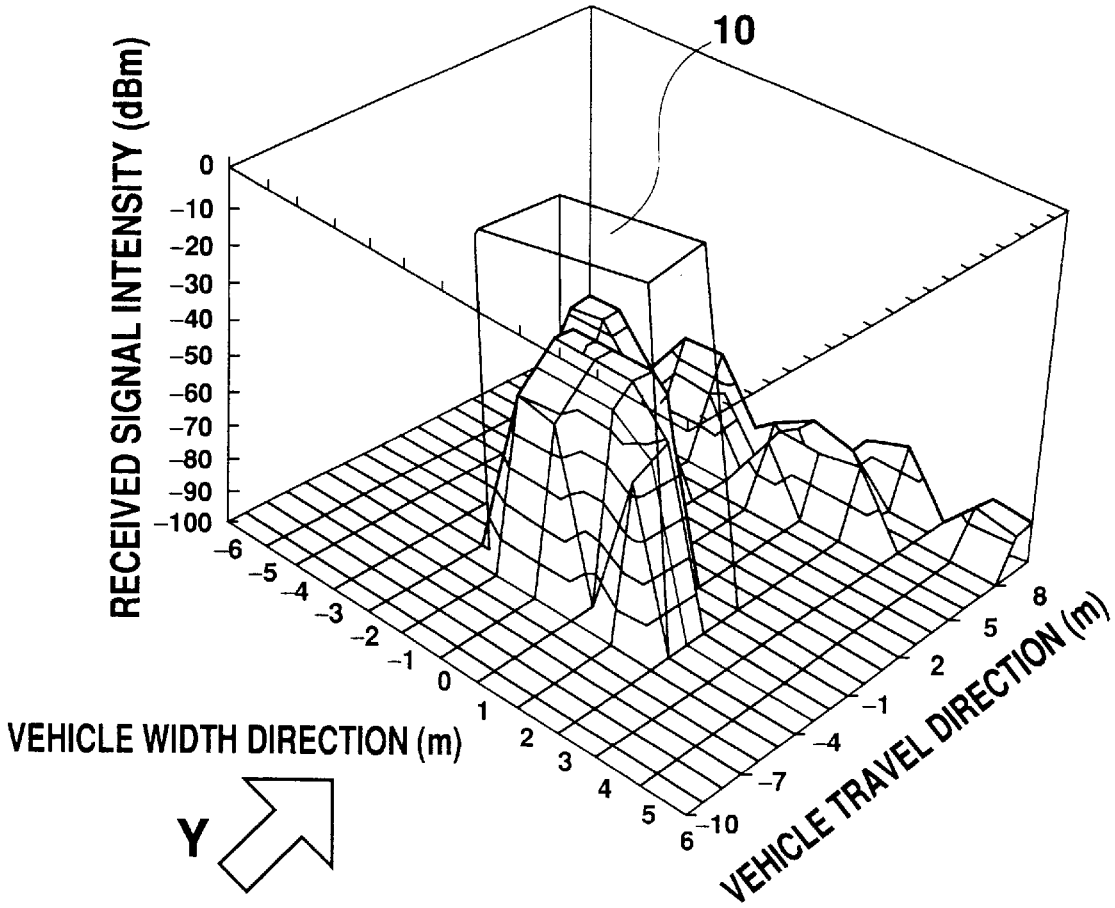
FIG. 8 is a diagram showing measured values of the output of the receiving system shown in FIG. 2.

According to the receiving system of FIG. 4, the output of the first gate 50 is as shown in FIG. 8, therefore the output obtained corresponds only to radio waves emanating from the toll collection area 10, and communication takes place only with the ETC vehicle 16 inside the toll collection area 10.

According to this embodiment, an example was shown where a sector beam antenna, which has a radiation pattern with very low leakage, was used. However the beam width and radiating pattern may be set as required provided that a higher antenna gain than that of a broad beam antenna is obtained only when the vehicle is inside the toll collection area. Hence other beam antennae may also be used such as a cosecant square beam, conical beam, elliptical beam or biconical beam. The elements used in the sector beam antenna or broad beam antenna may be microstrip, dipole, helical or slot elements. Further, the radio waves used may be circularly polarized, linearly polarized or non-polarized.

Embodiment 2

Figure 9:
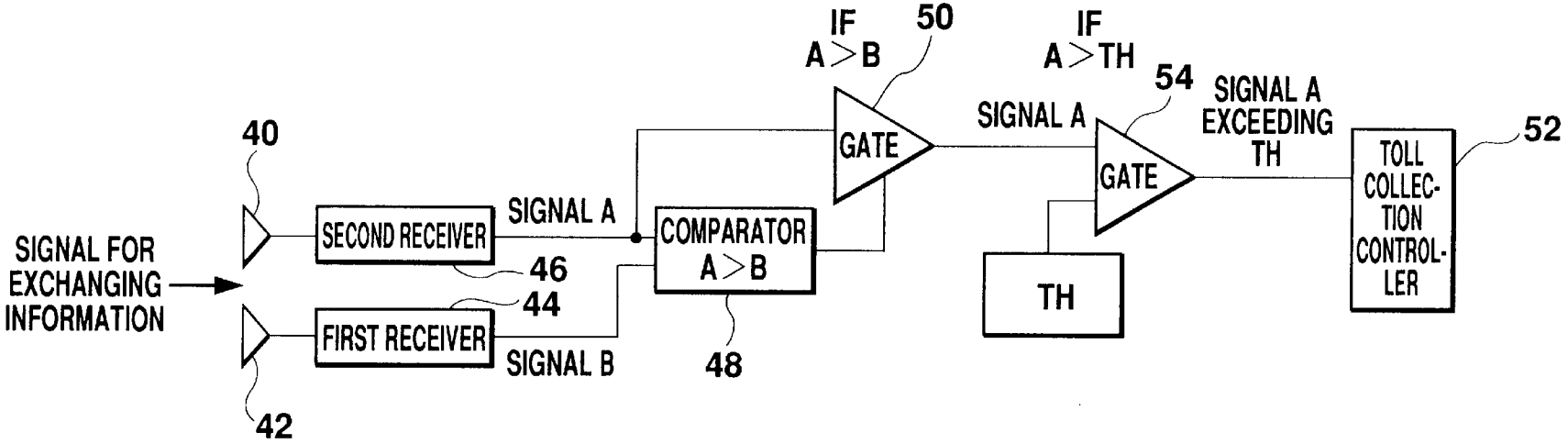
FIG. 9 is a block diagram showing a second example of the receiving system of the non-stop automatic toll collection system according to this invention.

FIG. 9 is a block diagram showing another construction of a receiving system for determining whether a received signal has emanated from a vehicle outside or inside the toll collection area 10. The signal from the vehicle-mounted device 18 is received by both the sector beam antenna 40 and broad beam antenna 42. The first receiver 44 is connected to the broad beam antenna 42, and the first receiver outputs a received signal B having an intensity which depends on the intensity of the received radio wave. The second receiver 46 is connected to the sector beam antenna 40, and it outputs a received signal A having an intensity which depends on the intensity of the received radio wave. The two received signals A, B are compared by the comparator 48, and when the received signal A is stronger, the first gate 50 is opened. The output of the first gate 50 is input to a second gate 54. The second gate 54 outputs the input signal A when it is equal to or greater than a threshold level TH which is set based on the signal level that can be received by the second receiver 46. Based on this output, the toll collection controller 52 collects a charge.

Figure 10:
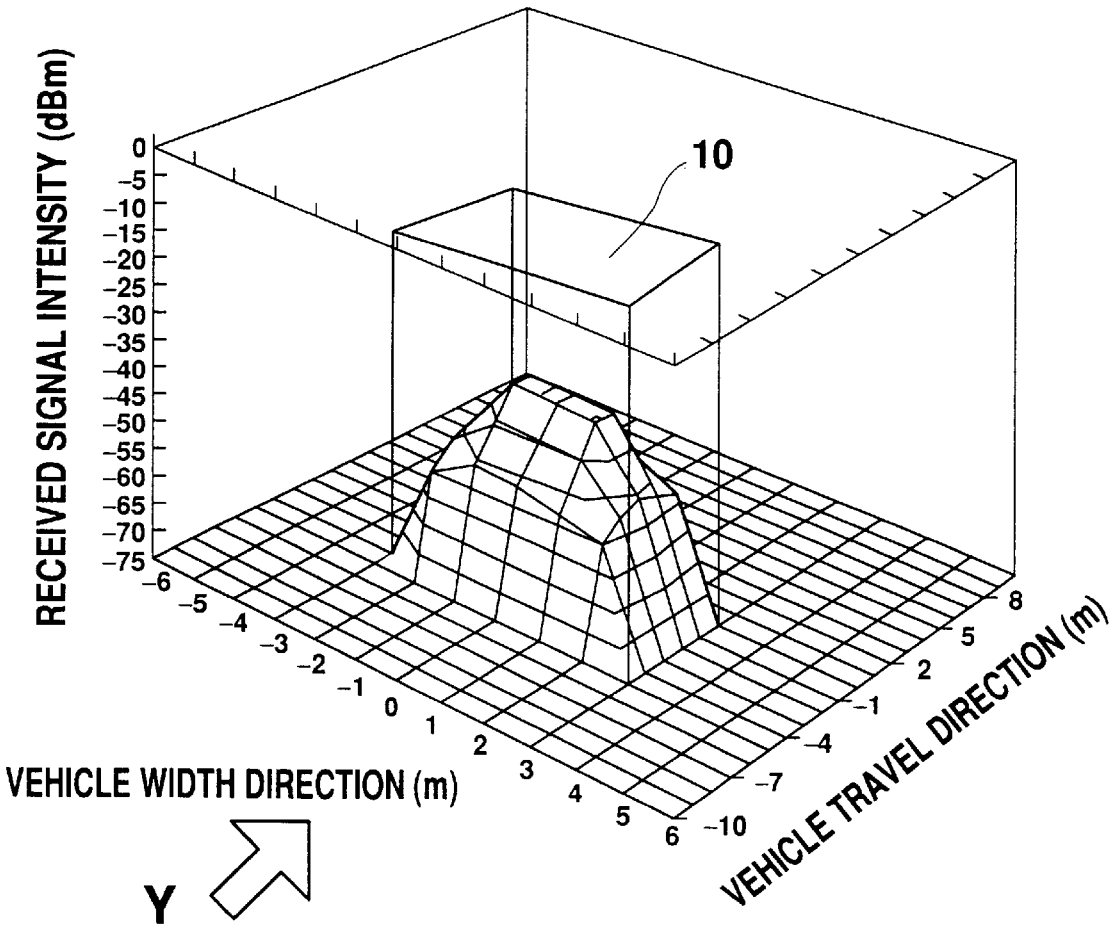
FIG. 10 is a diagram showing measured values of the output of the receiving system shown in FIG. 9.

If the two antennae 40, 42 which respectively have the characteristics shown in FIG. 6 and FIG. 7, and the receiving system shown in FIG. 9, are used, and the threshold level TH is −75 dBm, the receiving properties shown in FIG. 10 are obtained. Therefore the output obtained corresponds only to radio waves emanating from the toll collection area 10, and communication takes place only with the ETC vehicle 16 inside the toll collection area 10.

Embodiment 3

Figure 11:
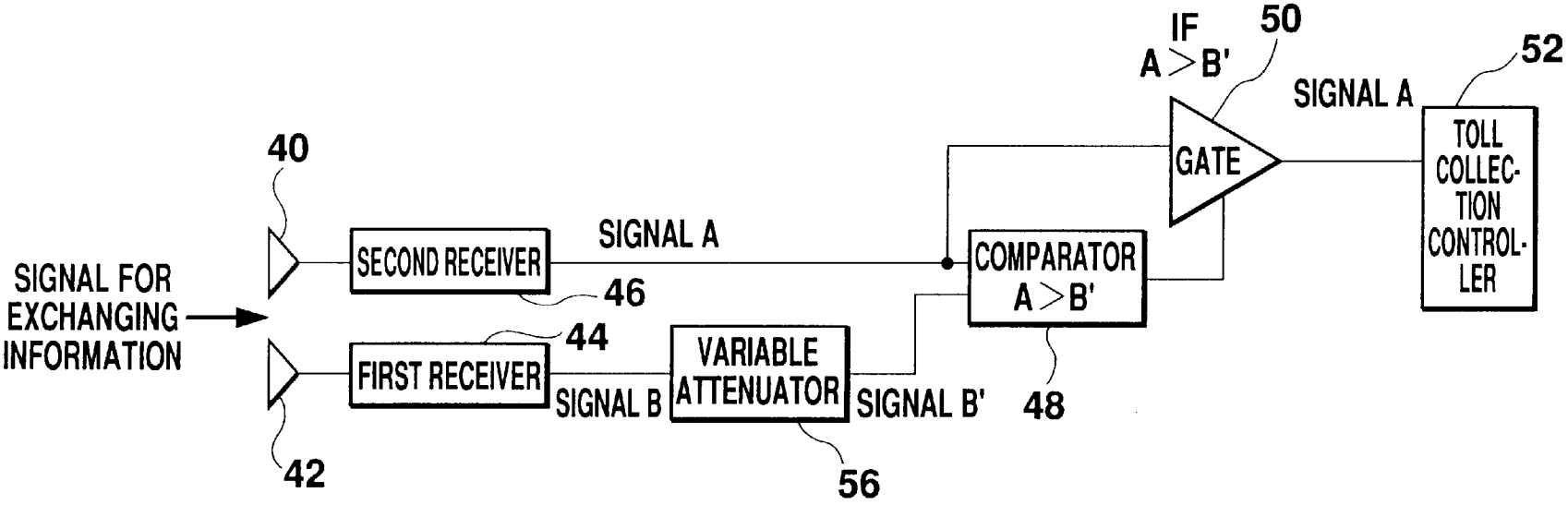
FIG. 11 is a block diagram showing a third example of the receiving system of the non-stop automatic toll collection system according to this invention.

FIG. 11 is a block diagram showing the construction of a system for determining whether a received signal has emanated from a vehicle outside or inside the toll collection area 10. The signal from the vehicle-mounted device 18 is received by both the sector beam antenna 40 and broad beam antenna 42. The first receiver 44 is connected to the broad beam antenna 42, and the first receiver outputs a received signal B having an intensity which depends on the intensity of the received radio wave. The gain of the signal B is adjusted by a variable attenuator 56 so as to obtain a received signal B'. The second receiver 46 is connected to the sector beam antenna 40, and it outputs a received signal A having an intensity which depends on the intensity of the received radio wave. The two received signals A, B' are compared by the comparator 48, and when the received signal A is stronger, the first gate 50 is opened. Based on the output of the first gate 50, the toll collection controller 52 collects a charge. The variable attenuator 56 is adjusted such that the directional properties or receiving characteristics of the two antennae 40, 42 are inverted depending on whether a vehicle is inside or outside the toll collection area 10. Hence, the desired receiving characteristics may be precisely obtained, and additionally, the toll collection area set by the entry sensor 12 and exit sensor 14 may be made to precisely correspond with the toll collection area set by the gains of the two antennae.

If the two antennae 40, 42 which respectively have the characteristics shown in FIG. 6 and FIG. 7, and the receiving system shown in FIG. 11, are used, the receiving properties shown in FIG. 8 are obtained. Therefore the output obtained corresponds only to radio waves emanating from the toll collection area 10, and communication takes place only with the ETC vehicle 16 inside the toll collection area 10.

Embodiment 4

Figure 12:
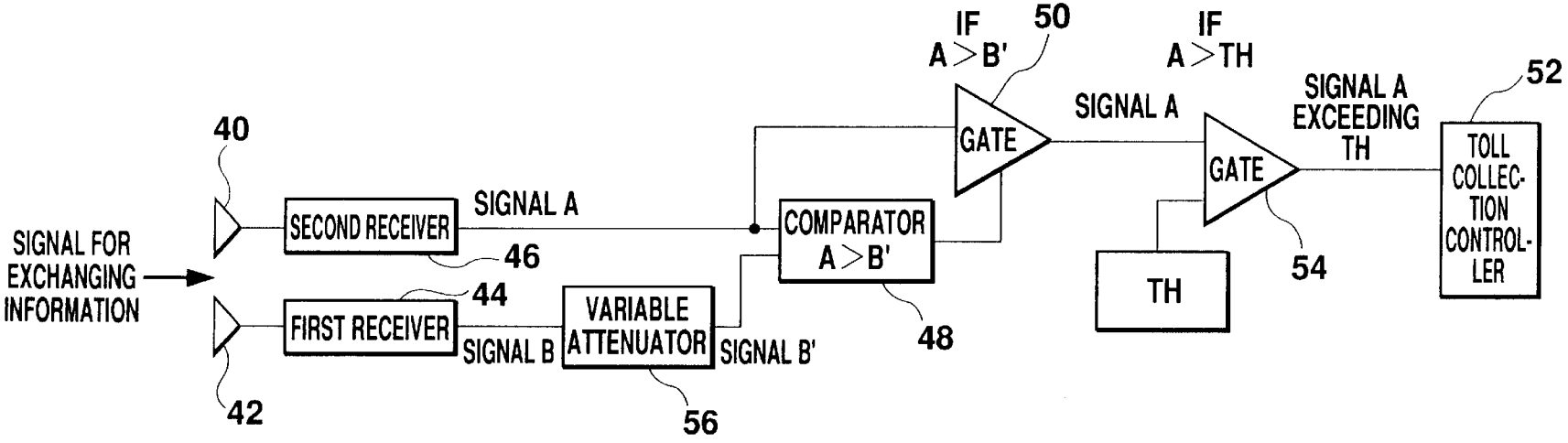
FIG. 12 is a block diagram showing a fourth example of the receiving system of the non-stop automatic toll collection system according to this invention.

FIG. 12 is a block diagram showing the construction of a system for determining whether a received signal has emanated from a vehicle outside or inside the toll collection area 10. The signal from the vehicle-mounted device 18 is received by both the sector beam antenna 40 and broad beam antenna 42. The first receiver 44 is connected to the broad beam antenna 42, and the first receiver outputs a received signal B having an intensity which depends on the intensity of the received radio wave. The gain of the signal B is adjusted by a variable attenuator 56 so as to obtain a received signal B'. The second receiver 46 is connected to the sector beam antenna 40, and it outputs a received signal A having an intensity which depends on the intensity of the received radio wave. The two received signals A, B' are compared by the comparator 48, and when the received signal A is stronger, the first gate 50 is opened. The output of the first gate 50 is input to the second gate 54. The second gate 54 outputs the input signal A when it is equal to or greater than the threshold level TH which is set based on the signal level that can be received by the second receiver 46. Based on this output, the toll collection controller 52 collects a charge. The variable attenuator 56 is adjusted such that the directional properties or receiving characteristics of the two antennae 40, 42 are inverted depending on whether a vehicle is inside or outside the toll collection area 10. Hence, the desired receiving characteristics may be precisely obtained, and additionally, the toll collection area set by the entry sensor 12 and exit sensor 14 may be made to precisely correspond with the toll collection area set by the gains of the two antennae.

If the two antennae 40, 42 which respectively have the characteristics shown in FIG. 6 and FIG. 7, and the receiving system shown in FIG. 12 are used, and the threshold level is −75 dBm, the receiving properties shown in FIG. 10 are obtained. Therefore the output obtained corresponds only to radio waves emanating from the toll collection area 10, and communication takes place only with the ETC vehicle 16 inside the toll collection area 10.

Embodiment 5

Figure 13:
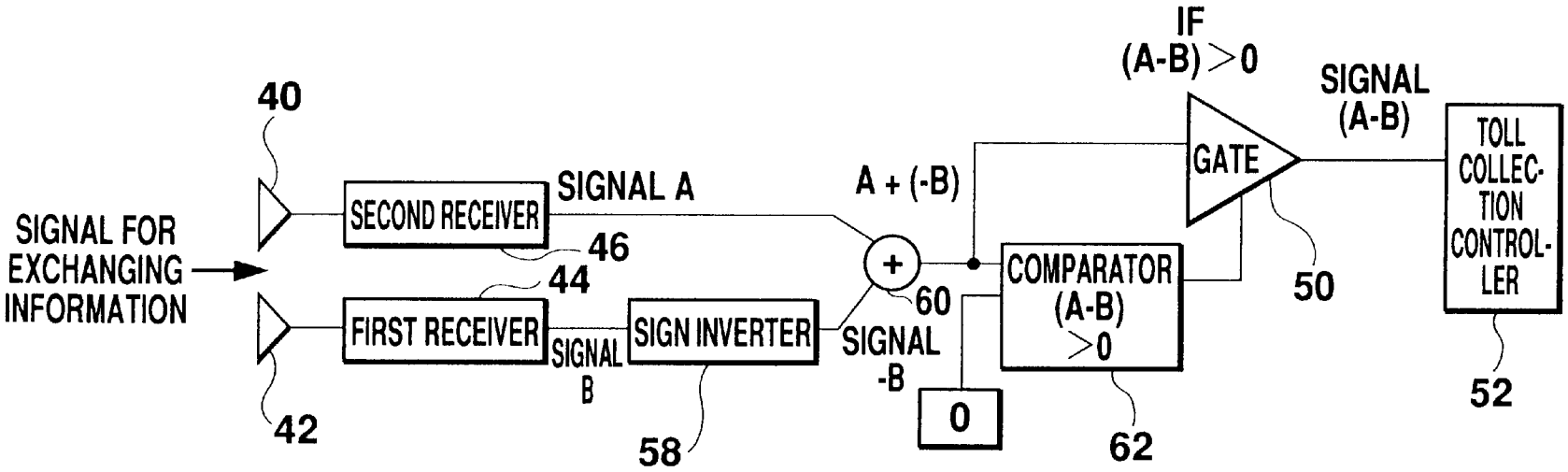
FIG. 13 is a block diagram showing a fifth example of the receiving system of the non-stop automatic toll collection system according to this invention.

FIG. 13 is a block diagram showing the construction of a system for determining whether a received signal has emanated from a vehicle outside or inside the toll collection area 10. The signal from the vehicle-mounted device 18 is received by both the sector beam antenna 40 and broad beam antenna 42. The first receiver 44 is connected to the broad beam antenna 42, and the first receiver outputs a received signal B having an intensity which depends on the intensity of the received radio wave. The sign of the received signal B is inverted by a sign inverter 58 so that it becomes a received signal (−B). The second receiver 46 is connected to the sector beam antenna 40, and it outputs a received signal A having an intensity which depends on the intensity of the received radio wave. The two received signals A, −B are added by an adder 60 so as to generate a signal (A−B). This signal (A−B) is compared with 0 by a comparator 62, and when the signal (A−B) is greater than 0, the first gate 50 is opened. Therefore, the signal (A−B) is output from the gate 50 only when the signal (A−B) is positive. Based on this output, the toll collection controller 52 collects a charge.

If the two antennae 40, 42 which respectively have the characteristics shown in FIG. 6 and FIG. 7, and the receiving system shown in FIG. 13, are used, the receiving properties shown in FIG. 8 are obtained. Therefore the output obtained corresponds only to radio waves emanating from the toll collection area 10, and communication takes place only with the ETC vehicle 16 inside the toll collection area 10.

Embodiment 6

Figure 14:
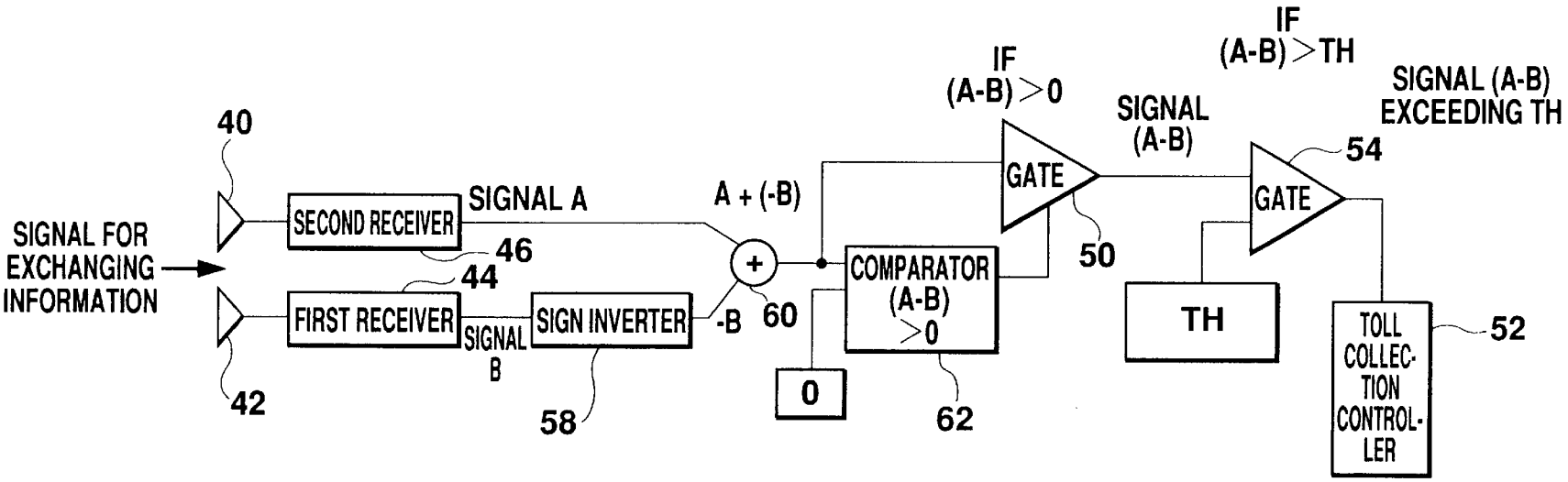
FIG. 14 is a block diagram showing a sixth example of the receiving system of the non-stop automatic toll collection system according to this invention.
Figure 15:
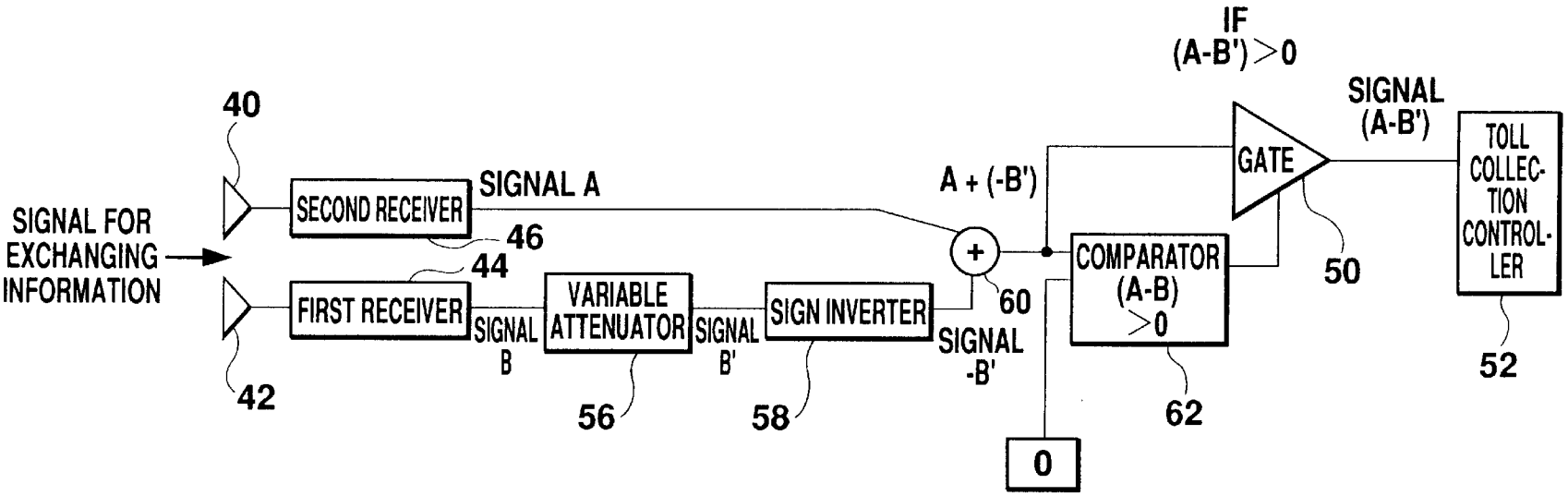
FIG. 15 is a block diagram showing a seventh example of the receiving system of the non-stop automatic toll collection system according to this invention.

FIG. 14 is a block diagram showing the construction of a system for determining whether a received signal has emanated from a vehicle outside or inside the toll collection area 10. The signal from the vehicle-mounted device 18 is received by both the sector beam antenna 40 and broad beam antenna 42. The first receiver 44 is connected to the broad beam antenna 42, and the first receiver outputs a received signal B having an intensity which depends on the intensity of the received radio wave. The sign of the received signal B is inverted by the sign inverter 58 so that it becomes a received signal (−B). The second receiver 46 is connected to the sector beam antenna 40, and it outputs a received signal A having an intensity which depends on the intensity of the received radio wave. The two received signals A, −B are added by the adder 60 so as to generate a signal (A−B). This signal (A−B) is compared with 0 by the comparator 62, and when the signal (A−B) is greater than 0, the first gate 50 is opened. Therefore, the signal (A−B) is output from the gate 50 only when the signal (A−B) is positive. The output of the first gate 50 is input to the second gate 54. The second gate 54 outputs the input signal A when it is equal to or greater than the threshold level TH which is set based on the signal level, i.e. the S/N ratio, that can be received by the second receiver 46. Based on this output, the toll collection controller 52 collects a charge.

If the two antennae 40, 42 which respectively have the characteristics shown in FIG. 6 and FIG. 7, and the receiving system shown in FIG. 12, are used, and the threshold level is −75 dBm, the receiving properties shown in FIG. 10 are obtained. Therefore the output obtained corresponds only to radio waves emanating from the toll collection area 10, and communication takes place only with the ETC vehicle 16 inside the toll collection area 10.

Embodiment 7

FIG. 13 is a block diagram showing the construction of a system for determining whether a received signal has emanated from a vehicle outside or inside the toll collection area 10. The signal from the vehicle-mounted device 18 is received by both the sector beam antenna 40 and broad beam antenna 42. The first receiver 44 is connected to the broad beam antenna 42, and the first receiver outputs a received signal B having an intensity which depends on the intensity of the received radio wave. The gain of the signal B is adjusted by the variable attenuator 56 so as to obtain a received signal B'. Further, the sign of the received signal B' is inverted by a sign inverter 58 so that it becomes a received signal (−B'). The second receiver 46 is connected to the sector beam antenna 40, and it outputs a received signal A having an intensity which depends on the intensity of the received radio wave. The two received signals A, −B' are added by the adder 60 so as to generate a signal (A−B'). This signal (A−B') is compared with 0 by a comparator 62, and when the signal (A−B') is greater than 0, the first gate 50 is opened. Therefore, the signal (A−B') is output from the gate 50 only when the signal (A−B') is positive. Based on this output, the toll collection controller 52 collects a charge.

If the two antennae 40, 42 which respectively have the characteristics shown in FIG. 6 and FIG. 7, and the receiving system shown in FIG. 13 are used, the receiving properties shown in FIG. 8 are obtained. Therefore the output obtained corresponds only to radio waves emanating from the toll collection area 10, and communication takes place only with the ETC vehicle 16 inside the toll collection area 10.

Embodiment 8

Figure 16:
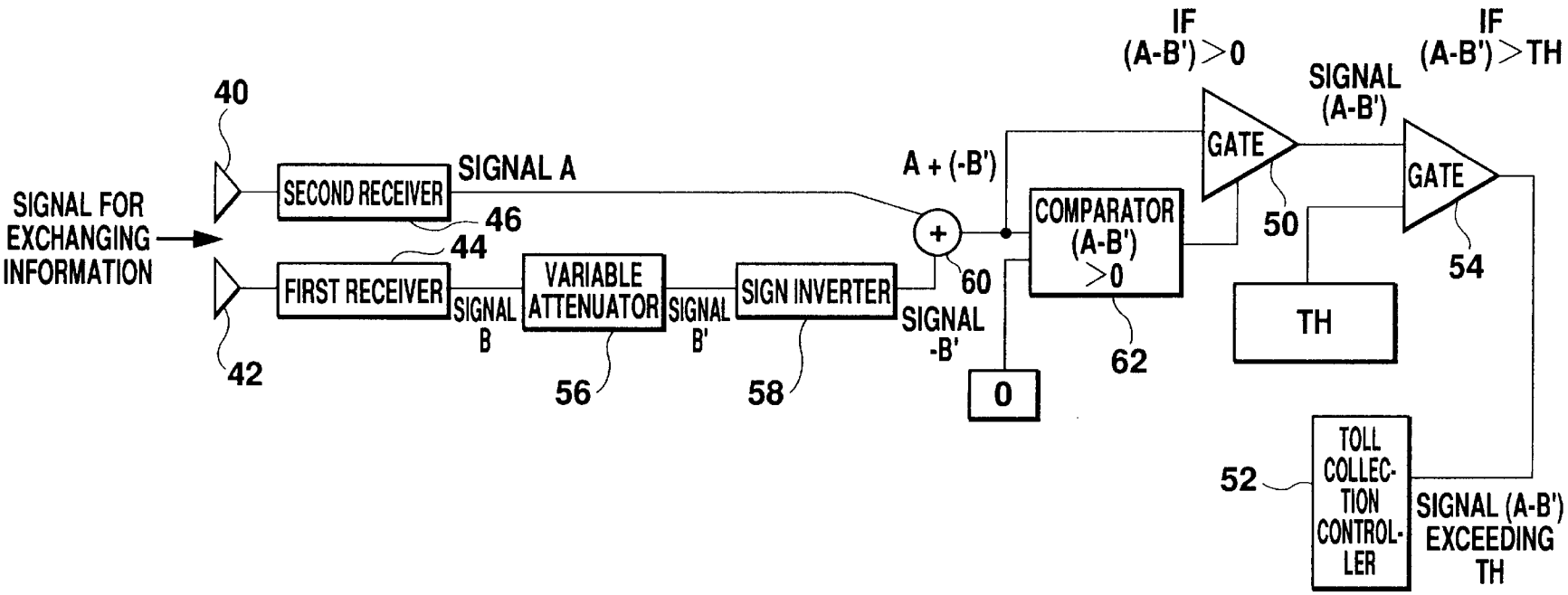
FIG. 16 is a block diagram showing an eighth example of the receiving system of the non-stop automatic toll collection system according to this invention.

FIG. 16 is a block diagram showing the construction of a system for determining whether a received signal has emanated from a vehicle outside or inside the toll collection area 10. The signal from the vehicle-mounted device 18 is received by both the sector beam antenna 40 and broad beam antenna 42. The first receiver 44 is connected to the broad beam antenna 42, and the first receiver outputs a received signal B having an intensity which depends on the intensity of the received radio wave. The gain of the signal B is adjusted by the variable attenuator 56 so as to obtain a received signal B'. Further, the sign of the received signal B' is inverted by the sign inverter 58 so that it becomes a received signal (−B'). The second receiver 46 is connected to the sector beam antenna 40, and it outputs a received signal A having an intensity which depends on the intensity of the received radio wave. The two received signals A, −B' are added by the adder 60 so as to generate a signal (A−B'). This signal (A−B') is compared with 0 by the comparator 62, and when the signal (A−B') is greater than 0, the first gate 50 is opened. Therefore, the signal (A−B') is output from the gate 50 only when the signal (A−B') is positive. The output of the first gate 50 is input to the second gate 54. The second gate 54 outputs the input signal A when it is equal to or greater than the threshold level TH which is set based on the signal level that can be received by the second receiver 46. Based on this output, the toll collection controller 52 collects a charge.

If the two antennae 40, 42 which respectively have the characteristics shown in FIG. 6 and FIG. 7, and the receiving system shown in FIG. 12 are used, and the threshold level is −75 dBm, the receiving properties shown in FIG. 10 are obtained. Therefore the output obtained corresponds only to radio waves emanating from the toll collection area 10, and communication takes place only with the ETC vehicle 16 inside the toll collection area 10.

What is claimed:

1. An automatic toll collection system for exchanging information by radio between a vehicle-mounted device mounted on a vehicle and a toll station, comprising:

a first receiver installed in said toll station for receiving a signal from said vehicle-mounted device, said first receiver having first directional properties, and a second receiver installed in said toll station for receiving a signal from said vehicle-mounted device, said second receiver having second directional properties, said second directional properties being such that an intensity of a signal received by said second receiver is greater than an intensity of a signal received by said first receiver when said vehicle-mounted device is situated inside a toll collection area, and the intensity of the signal received by said second receiver is less than the intensity of the signal received by said first receiver when said vehicle-mounted device is situated outside said toll collection area, and further comprising:

a determining unit for determining whether a vehicle is situated inside said toll collection area based on the intensity of the signals received from said first and second receivers, and permitting collection of a charge when said vehicle is situated inside said toll collection area.

2. An automatic toll collection system as defined in claim 1, wherein one or both of said first receiver or said second receiver comprises a variable attenuator for adjusting the intensity of the received signal.

3. An automatic toll collection system as defined in claim 2, wherein said determining unit further permits collection of a charge when the intensity of signal received by said second receiver is equal to or greater than a predetermined value which is determined based on a S/N ratio of said second receiver.

4. An automatic toll collection system as defined in claim 1, wherein said determining unit comprises a comparator for comparing the intensities of the signals received by said first and second receivers, and transmits the output of said second receiver when it is determined by said comparator that the intensity of the signal received by said second receiver is higher.

5. An automatic toll collection system as defined in claim 4, wherein one or both of said first receiver or said second receiver comprises a variable attenuator for adjusting the intensity of the received signal.

6. An automatic toll collection system as defined in claim 5, wherein said determining unit further permits collection of a charge when the intensity of signal received by said second receiver is equal to or greater than a predetermined value which is determined based on a S/N ratio of said second receiver.

7. An automatic toll collection system as defined in claim 1, wherein said determining unit comprises:

a sign-inverting unit for inverting a sign of the signal received by said first receiver, an adder for adding the signal received by said second receiver and the sign-inverted signal received by said first receiver, a comparator for comparing the output of said adder with 0, and a gate for transmitting said addition result when said comparator determines that the output of said adder exceeds 0.

8. An automatic toll collection system as defined in claim 7, wherein one or both of said first receiver or said second receiver comprises a variable attenuator for adjusting the intensity of the received signal.

9. An automatic toll collection system as defined in claim 1, wherein the first receiver has a strong directionality, and the second receiver has a weak directionality.

10. An automatic toll collection system as defined in claim 9, where said first receiver comprises a sector beam antenna, and said second receiver comprises a broad-beam antenna.

11. An automatic collection system as defined in claim 1, wherein said first receiver has a directionality which at least partially overlaps said directionality of said second receiver.

12. An automatic collection system as defined in claim 9, wherein said first receiver has a directionality which at least partially overlaps said directionality of said second receiver.

* * * * *